United States Patent [19]

Stole

[11] 4,452,476

[45] Jun. 5, 1984

[54] SECURITY DEVICE

[76] Inventor: Donald M. Stole, Rte. 3, Box 295, Sherwood, Oreg. 97140

[21] Appl. No.: 239,662

[22] Filed: Mar. 2, 1981

[51] Int. Cl.[3] ..... E05C 17/36

[52] U.S. Cl. ..... 292/150; 292/264

[58] Field of Search ..... 292/142, 150, 264, 346, 292/340, 137, 175

[56] References Cited

U.S. PATENT DOCUMENTS

| | | | |
|---|---|---|---|
| 17,464 | 6/1857 | Westcott | 292/142 |
| 305,294 | 9/1884 | Corn | 292/150 |
| 1,235,446 | 7/1917 | Dastoli | 292/150 X |
| 1,510,562 | 10/1924 | Segal | 292/150 |
| 2,726,112 | 12/1955 | Conhagen | 292/264 |
| 3,264,018 | 8/1966 | Houvener | 292/150 X |

*Primary Examiner*—Richard E. Moore

*Attorney, Agent, or Firm*—Chernoff, Vilhauer, McClung, Birdwell & Stenzel

[57] ABSTRACT

A security device is presented which includes a dead man member to be imbedded in a door jamb and a sleeve and slide to be mounted upon the jamb. Also presented is a chain loop for coupling a door knob to the security device.

7 Claims, 4 Drawing Figures

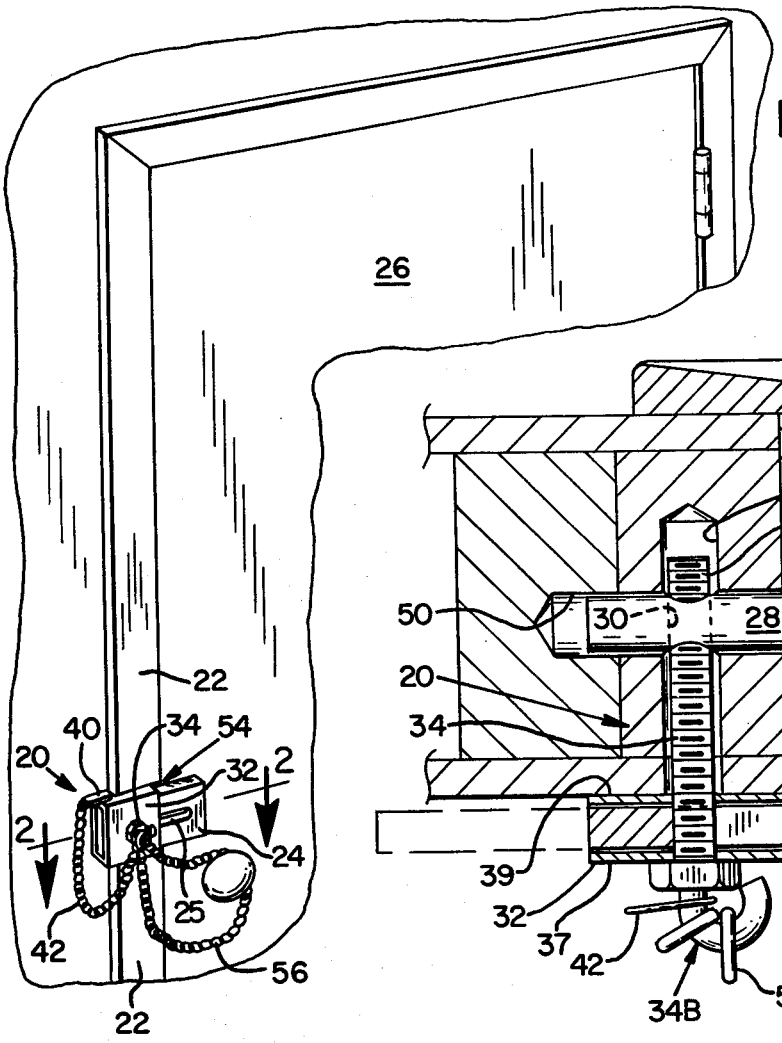
FIG. 1
FIG. 2
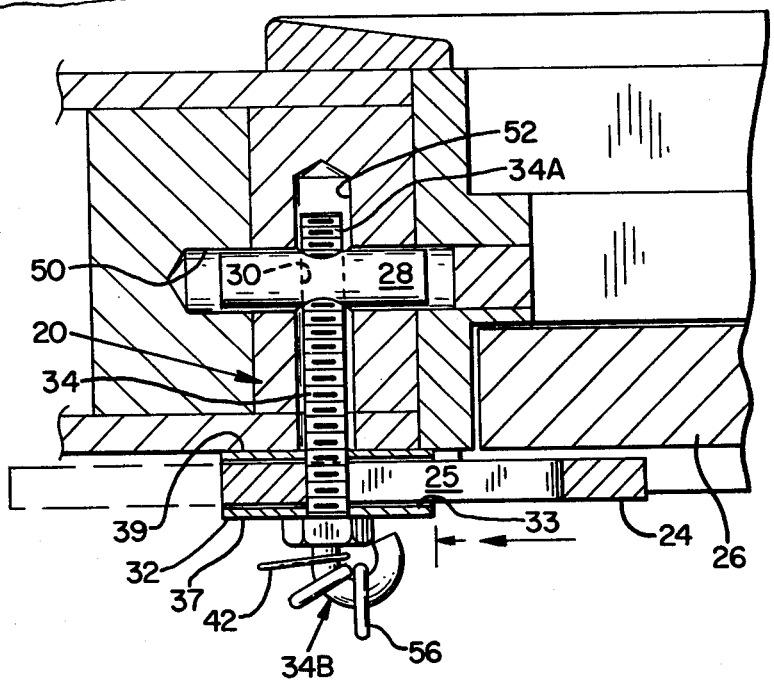
FIG. 3
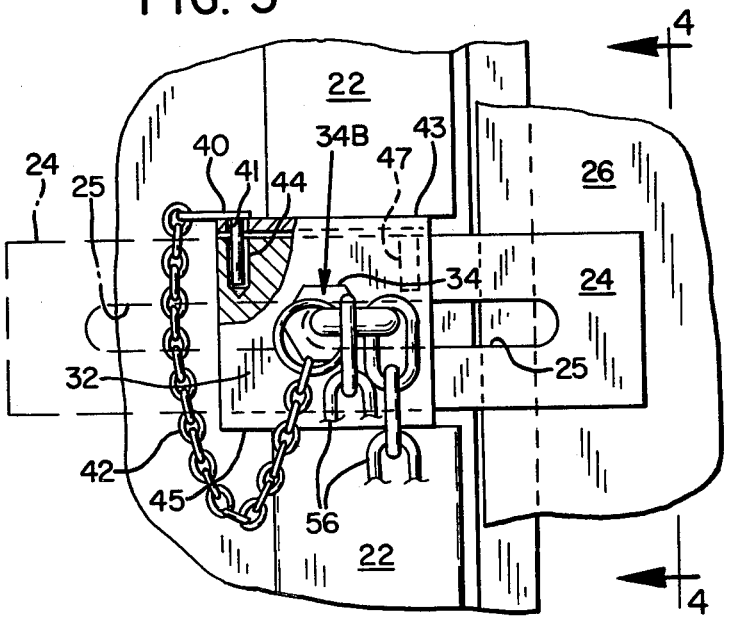
FIG. 4
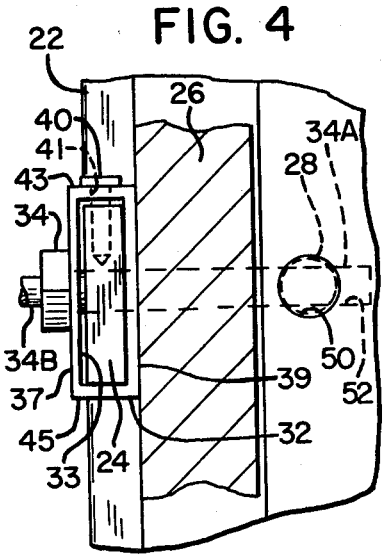

SECURITY DEVICE

BACKGROUND

A large number of locking devices have been presented for securing doors of homes, apartments and the like, each of which has a movable member which can be selectively placed with one end imbedded in the door and one end extending into the jamb. A major deficiency of these devices is that they are prone to both picking and to having the end forced out of the jamb.

Another approach has been to use a series of locks for a single door including, in some cases, what is known in the industry as a dead bolt. The difficulty with this latter approach is that it achieves higher security at the price of costly and complex locking systems, together with significantly increasing the amount of time and effort which must be expended to lock and unlock the door.

A related problem involves permitting the door to be partially opened in order to, for example, receive a small package while simultaneously reserving some security. Here, a number of chains have been presented for selectably coupling the door to the door jamb. These devices however are ordinarily held in place by relatively small screws, especially where the door is of hollow, lightweight construction, and are displaceable by subjecting a modicum of force against the door.

OBJECTIVE

The present invention has as its object the provision of a relatively uncomplex locking mechanism which can not be picked or removed from the exterior without physical destruction of the door.

A second object of the present invention is to provide an improvement for door chain devices in order to eliminate removal thereof from the exterior by application of a modicum of force applied against the door.

Yet other objects, features and advantages of the invention will be more readily understood by review of the accompanying drawings and of the detailed descriptions and claims which follow.

DRAWINGS

FIG. 1 is a perspective view of an exemplary embodiment of the security device of the present invention depicted mounted in place upon a door jamb.

FIG. 2 is a partial cut-away of the security device of FIG. 1 taken along line 2—2 of FIG. 1.

FIG. 3 is an expanded, partial cut-away view of the security device of FIG. 1.

FIG. 4 is a partial cross section view of the security device of FIG. 1 taken along line 4—4 of FIG. 3.

DETAILED DESCRIPTION

Turning now to the drawings, numeral 20 refers generally to the present security device which is mounted in a door jamb 22 such as to selectively dispose a slide member 24 part way across the interior of a door 26.

At the outset, it is important to note that, although the shape or ornament of security device 20 could be varied without departing from the scope of the present invention, the symmetry shown is significant as it permits, by way of reversal, device 20 to be used for either of both left hand and right hand doors.

Security device 20 includes a dead man member 28 which is exemplarily depicted as an elongate section of rod steel, being $\frac{5}{8}''$ in diameter and about 1.5 inches in length. Dead man member 28 is drilled and tapped so as to have machine threaded surfaces (indicated generally by dash line 30 in FIG. 2) extending therethrough transverse to its longest dimension.

Security device 20 further includes a metal sleeve 32 and an elongate bolt member 34 for mechanically coupling slide member 24 with dead man member 28.

As best seen in FIG. 2, sleeve 32 is elongate and has a throughbore channel formed therethrough which extends from, through and to its opposing ends and has suitable cross section and configuration as to house slide member 24 and permit lateral movement of slide member 24 through and along the channel. Sleeve 32 also includes a central throughbore formed therein which extends from, through and to its opposing front and back major faces 37 and 39, and is of suitable cross section as to house bolt member 34 and to permit rotation of bolt member 34 therein.

Sleeve 32 has means defining an aperture 41 extending through its top and bottom minor faces, 43 and 45, adjacent one end of sleeve 32 which has suitable cross section for closely receiving therethrough an elongate pin 40.

Slide member 24 is, for example, a rectangular piece of $\frac{1}{4}''$ steel, being about 3" in length and 1.5" in width, and has an elongate slot 25 formed therein. Slot 25 extends in the direction of the longest dimension of slide member 24 and terminates at each end about $\frac{3}{4}''$ from the ends of slide member 24. It is also significant to note that slot 25 is of sufficient width to receive therethrough the $\frac{5}{8}''$ shank of bolt member 34 and, preferably, is centered so as to align with the throughbore of sleeve 32.

Bolt member 34 has a $\frac{5}{8}''$ machine threaded shank, 34A, which extends through sleeve 32 and slide 24 and threads into dead man member 28, and an enlarged head portion 34B which engages the front major face 37 of sleeve 32. It will be appreciated that this construction permits the assembly to be readily assembled. It is also significant to note that security device 20 further includes a first, elongate chain member 42 of multiple links, having a first end fastened to head portion 34B and its opposing end fastened to pin 40. This permits pin 40 to be detachably placed through aperture 41 of sleeve 32 into either of the pair of blind bores 44 and 47 of slide member 24 to selectively prevent movement of slide member 24 by maintaining same in either of two laterally displaced positions.

Referring to FIG. 2, the door jamb is readily prepared for installation by drilling a first hole 50 into the interior portion of the door jamb and a second hole 52 into the facing portion of the door jamb such that the latter intersects with the former. It being noted that it may also be necessary to notch the facing portion as is generally indicated by arrow 54 in FIG. 1.

Assembly is had by placing dead man member 28 into hole 50 such that its threaded surfaces align with hole 52, by placing slide member 24 into sleeve 32, by placing sleeve 32 into notch 54, by placing the shank portion 34A of bolt member 34 through both sleeve 32 and slide member 24 and by then threading bolt member 34 into dead man member 28.

In use, slide member 24 is moved into either its locking position (in front of door 26) or its released position (not in front of door 26), and, then locking slide member 24 into the desired position by inserting pin 40.

Preferably security device 20 also includes a second, elongate chain member 56 having both its ends fixedly attached to bolt member 34 thereby forming a closed loop. As best seen in FIG. 1, the loop is placed over door knob 58 as an additional security measure for permitting partial opening of door 26.

The terms used in the foregoing are terms of description and not of limitation it being understood that equivalents are being claimed and that the extent of the claimed invention is limited only by the claims which follow and equivalents thereto.

What is claimed is:

1. A dead man type security device adapted for mounting in a door jamb to selectively permit and prevent opening of a door, comprising:

(a) a sleeve having spaced apart front and back major faces, top and bottom minor faces and opposing open ends, said sleeve defining a channel of predetermined cross section extending through said sleeve from one said end to the other, a central throughbore extending through said sleeve from said front face through said back face, and an aperture extending through said top face adjacent one of said ends;

(b) a slide member, slidably mounted in said channel of said sleeve, said slide member being selectably moveable longitudinally through said sleeve, and defining an elongate slot extending therethrough, part of said slot being aligned with said central throughbore continuously as said slide member is moved within said channel, and defining a pair of spaced-apart blind bores in said slide member each said blind bore being aligned with said aperture at a different location said slide member within said channel;

(c) an elongate bolt, having a threaded end and an enlarged end, rotatably extending through both of said central throughbore of said sleeve and said slot of said slide member such that said enlarged end is engaged by said front face and said threaded end projects from said back face;

(d) dead man means detachably connected to said bolt and adapted to be located within a door jamb for fastening said sleeve and said slide member to said door jamb, said dead man means defining thread means located therein for receiving said threaded end of said bolt in threaded engagement therewith;

(e) an elongate flexible connecting member having opposing ends, one of said ends being mounted upon and mechanically fastened to said enlarged end of said bolt member; and (f) an elongate pin, one end thereof detachably and movably extending through said aperture of said sleeve into one of said blind bores of said slide member, for selectively preventing lateral movement of said slide member relative to said sleeve said pin being attached to the other of said opposing ends of said flexible connecting member.

2. The security device of claim 1 further comprising a second elongate flexible connecting member having a pair of opposite ends, each attached to said enlarged end of said bolt so as to form loop means for selectively coupling said device to a knob of a door by placement of said loop means over said knob.

3. The security device of claim 2 wherein said flexible connecting members are a chain.

4. The security device of claim 1 wherein said flexible connecting member is a chain.

5. A security device adapted for mounting in a door jamb to selectively permit and prevent opening of a door, comprising:

(a) an elongate sleeve defining a slide channel extending therethrough, said sleeve and slide channel each having at least one open end, said sleeve defining a central throughbore extending transversely therethrough and further defining an aperture extending therethrough into said slide channel;

(b) an elongate slide member slidably disposed within said slide channel, said slide member defining an elongate slot extending therethrough and longitudinally therealong, and further defining at least one blind bore extending thereinto in a position which is aligned with said aperture when said slide member is in a predetermined position in said slide channel;

(c) dead man means adapted to be inserted in a door jamb, for fastening said sleeve and said slide member to said door jamb, said dead man means including a threaded aperture therein for engaging a threaded portion of a bolt;

(d) a bolt removably extending through said central throughbore of said sleeve and through said slot of said slide member and being removably threadedly engaged in said threaded aperture in said dead man means;

(e) pin means for extending removably through said aperture of said sleeve into said blind bore of said slide member when said slide member is located in said slide channel in said predetermined position; and (f) flexible connecting means extending between said pin means and said bolt, for attaching said pin means to said bolt.

6. The security device of claim 5, wherein said slide member defines a plurality of said blind bores.

7. The security device of claim 5, further including flexible loop means connected to said bolt member for selectively being placed around a doorknob to prevent a door from being opened beyond a partially open position.

* * * * *